United States Patent [19]

Bauer

[11] 4,096,353

[45] Jun. 20, 1978

[54] MICROPHONE SYSTEM FOR PRODUCING SIGNALS FOR QUADRAPHONIC REPRODUCTION

[75] Inventor: Benjamin B. Bauer, Stamford, Conn.

[73] Assignee: CBS Inc., New York, N.Y.

[21] Appl. No.: 737,760

[22] Filed: Nov. 2, 1976

[51] Int. Cl.[2] ..... H04R 5/00

[52] U.S. Cl. ..... 179/1 GQ; 179/100.4 ST

[58] Field of Search ..... 179/1 GQ, 1 DM, 100.4 ST, 179/100.1 TD, 15 BT

[56] References Cited

U.S. PATENT DOCUMENTS

| | | | |
|---|---|---|---|
| 3,787,622 | 1/1974 | Itoh et al. | 179/1 GQ |
| 3,856,992 | 12/1974 | Cooper | 179/1 GQ |
| 3,940,560 | 2/1976 | Condamines | 179/1 GQ |

FOREIGN PATENT DOCUMENTS

| | | | |
|---|---|---|---|
| 2,214,431 | 10/1973 | Germany | 179/1 GQ |

*Primary Examiner*—Douglas W. Olms
*Attorney, Agent, or Firm*—Spencer E. Olson

[57] ABSTRACT

A system including a compact array of microphones and signal-combining circuitry, especially suited for use with surround-sound sources, for producing two composite output signals corresponding to those required by a matrix-type quadraphonic system to establish the directional position of the sources. The output signals from one embodiment of the system can be used directly to record an SQ-matrixed tape, or they can be applied to a disc cutter to produce an SQ record, and in another embodiment the output signals can be used directly to record a "regular matrix" (RM) tape or they can be applied to a disc cutter to produce an "RM" record. Thus, the disclosed systems perform the function of the conventional multi-microphone and encoding system for SQ or RM recording or broadcasting.

6 Claims, 9 Drawing Figures

MICROPHONE SYSTEM FOR PRODUCING SIGNALS FOR QUADRAPHONIC REPRODUCTION

BACKGROUND OF THE INVENTION

This invention relates to quadraphonic sound systems, and more particularly to a system for producing from surround-sound sources two composite signals which when decoded by an appropriate four-channel decoder reproduce the directional characteristics of the original sound sources.

In copending patent application Ser. No. 685,065, filed May 10, 1976, now U.S. Pat. No. 4,072,821, the present applicant has described a microphone system for producing signals for quadraphonic reproduction which includes four coaxial microphone transducers which typically define limaćon patterns of revolution corresponding to the equation, $\rho(\theta)=0.3+0.7\cos\theta$ where $\rho$ is the fraction of the maximum sensitivity of the sensor as a function of angular deviation $\theta$ from the positive direction of the axis of revolution. As described in connection with FIGS. 14 and 15 of the aforementioned copending application, a composite of which is presented in FIG. 1 of the accompanying drawings, the axes of maximum sensitivity of the four sensors typically are coplanar and are arranged azimuthally around a common axis such that one of the units, designated L1, is aimed at $-65°$, a second unit designated R1 is aimed at $+65°$, a third unit, designated L2, is aimed at $-165°$, (a third unit, designated L2, is aimed at $-165°$,) and a fourth unit, designated R2, is aimed at $+165°$.

The output from each of the two "front" sensors L1 and R1 is passed through a respective all-pass phase-shift network having a phase-shift angle that varies as a function $\psi$ of frequency. Similarly, the output signal from each of the two "back" sensors is passed through a respective all-pass network having a phase shift angle that varies as a $(\psi-90°)$ function of frequency. A predetermined fraction of the phase-shifted output of sensor R2 is subtracted from the phase-shifted output of sensor L1 to form a "total" or transmitted composite signal designated $L_T$, and a predetermined fraction of the phase-shifted output of the sensor L2 is subtracted from the phase-shifted output of sensor R1 to form a second composite signal, designated $R_T$. The composite signals $L_T$ and $R_T$ represent a coded quadraphonic output which, for specific directions of sound arrival in space correspond to the SQ code for the directions left back, left front, center front, right front and right back; for the center back direction the code is the same as for center front, so that the performance of the FIG. 1 system corresponds to that of a "forward-oriented" SQ encoder. The described system is particularly useful for the recording and/or transmitting of a dramatic presentation since it allows the performers to be positioned, and to walk around the microphone array while reproducing their positions from appropriate directions over a wide arc in space. It is shown in the aforementioned application that the respective polar patterns and the respective directions of maximum sensitivity of the limacóns, and the relative contributions of the "front" pair, L1 and R1, and the "back pair", L2 and R2, can be adjusted over a relatively wide limit while still achieving the desired encoding performance.

In the system described in the aforementioned application, the four limaćon patterns are obtained by using four gradient transducers and one omnidirectional transducer. The gradient transducers typically are arranged coaxially in their positive direction of maximum sensitivity at the aforementioned azimuth angles of $\pm65°$ and $\pm165°$, each furnishing approximately 70% of the signal output with sound incident from these directions, with the omnidirectional transducer furnishing the remainder, or about 30%, of the signal output, the latter being added equally to the outputs of the four gradient transducers.

SUMMARY OF THE INVENTION

A primary object of the present invention is to provide a system utilizing a microphone array and an encoding circuit for producing two composite signals equivalent to those required by known quadraphonic systems having a simpler and less expensive microphone array than that used in the system described in the aforementioned copending application.

Another object of this invention is to provide a microphone array-encoding circuit system for producing encoded composite signals equivalent to those required by the RM quadraphonic system to establish the directional position of surround-sound sources.

Briefly, the primary object of the invention is achieved with an array of two gradient microphones and a single omnidirectional microphone supported on a common vertical axis, with the axes of maximum sensitivity of the two gradient microphones oriented at an angle of 90° relative to each other and at respective azimuthal angles of 0° and 90°. Appropriate fractional portions of the output signal from one of the gradient microphones are combined with appropriate fractional portions of the output signal from the other gradient microphone to produce equivalent gradient patterns displaced at the aforementioned angles of $\pm65°$ and $\pm165°$. These latter equivalent patterns furnish a fractional portion of the output signal (approximately 70%) which is combined with a fractional portion (approximately 30%) of the output signal from the omnidirectional microphone so as to produce the four limaćon polar patterns characterized by the normalized limaćon equation $E = 0.3 + 0.7\cos\theta$. The four resultant signals are selectively phase-shifted and combined to produce two composite encoded signals of the kind utilized in the SQ quadraphonic sound system, as described in the copending application.

According to another aspect of this invention, the aforementioned array of two gradient microphones and a single omnidirectional microphone is formed of a commercially available microphone which contains four limaćon patterns characterized by the equation $m + (1-m)\cos\theta$, where $0<m<1$ but where $m$ typically is 0.5. Applicant has recognized that by subtracting these outputs in opposite pairs, the two gradient patterns are obtained, and by adding them in opposite pairs, an omnidirectional pattern is obtained which may be used in the manner described above to produce the four limaćon equations $0.3 + 0.7\cos\theta$.

In accordance with another aspect of the invention, an array of microphones produces four limaćon directional patterns oriented at 90° from each other in space, each defined by the equation $E = 0.414 + 0.586\cos\theta$, where $\theta$ is the angular direction measured from the direction of maximum sensitivity. The output signals representative of the four limaćon patterns are selectively phase-shifted and combined to produce two composite signals having the characteristics of the composite signals required by the RM quadraphonic system to establish the directional position of surround-sound sources.

DESCRIPTION OF THE PREFERRED EMBODIMENTS

Figure 1:
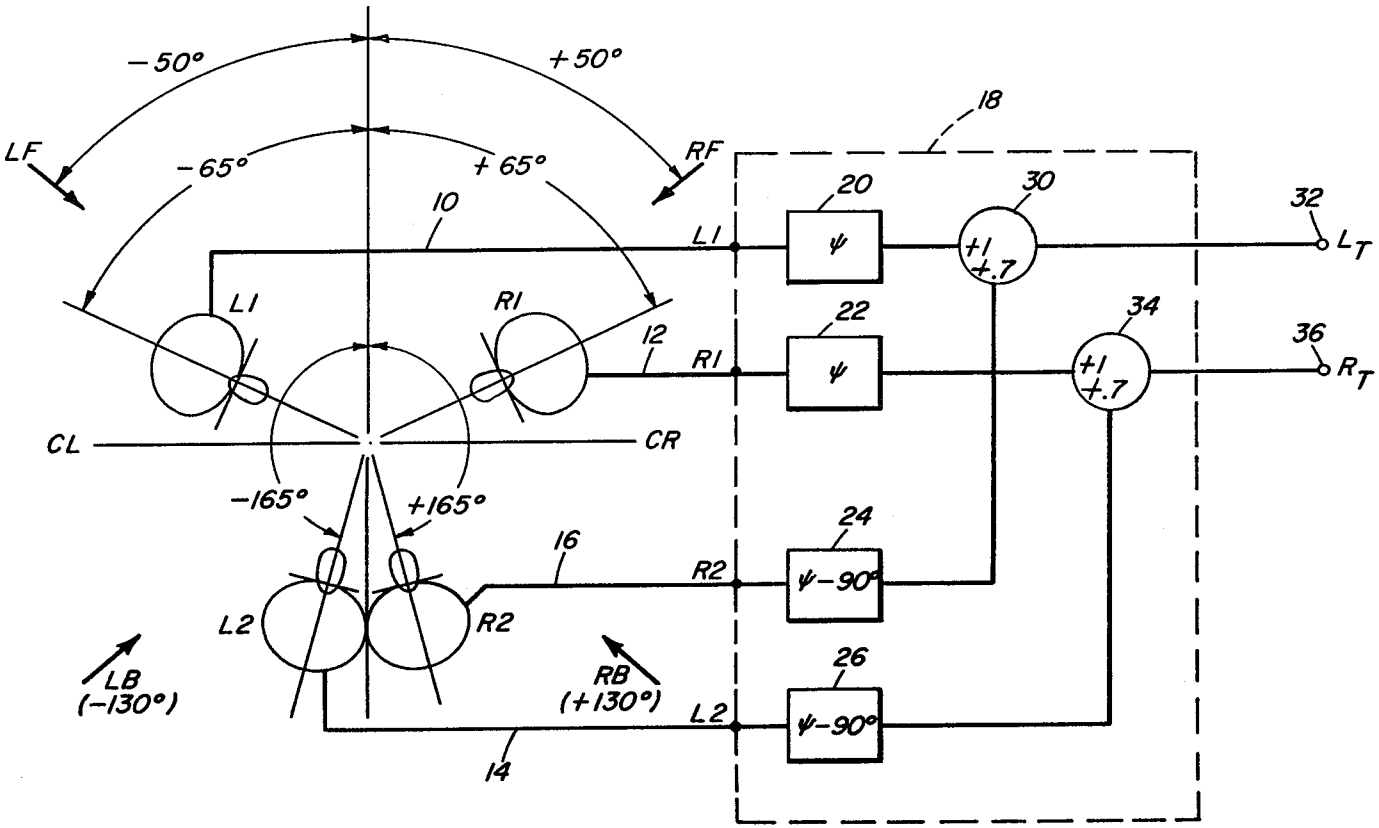
FIG. 1 is a diagram illustrating the microphone system described in applicant's aforementioned copending patent application.

As background for understanding of the present invention, reference is made to FIG. 1 which illustrates the essential features of the system described in applicant's copending application Ser. No. 685,065, filed May 10, 1976 now U.S. Pat. No. 4,072,821. In that system, four bi-directional microphones and a single omnidirectional microphone are supported on a common vertical axis and their output signals combined in a manner so as to define limaćon patterns of revolution each corresponding to the equation: $\rho(\theta) = 0.3 + 0.7\cos\theta$, where $\rho$ is the fraction of the maximum sensitivity of the sensor as a function of angular deviation $\theta$ from the positive direction of the axis of revolution. As shown in FIG. 1, the axes of maximum sensitivity of the microphone array are coplanar and are arranged such that the sensor designated L1 is aimed at $-65°$ (or counterclockwise from the positive direction,) the sensor designated R1 is aimed at $+65°$, and the sensors designated L2 and R2 are aimed at $-165°$ and $+165°$, respectively. The connections to the transducers defining these patterns are symbolically shown by the conductors 10, 12, 14 and 16 which, in turn, are connected to an encoder 18. The encoder includes four all-pass phase shift networks 20, 22, 24 and 26, the first two of which provide a phase-shift as a function $\psi$ of frequency, with the latter two providing a phase-shift which is a $(\psi - 90°)$ function of frequency. A fractional portion (about 70%) of the phase-shifted R2 signal from phase-shift network 24 is added in a summing junction 30 to the phase-shifted L1 signal from phase-shift network 20 to produce at an output terminal 32 a first composite signal, designated $L_T$. Similarly, approximately 70% of the phase-shifted L2 signal from phase shift network 26 is added in a second summing junction 34 to the phase-shifted R1 signal from phase shift network 22 to produce a second composite output signal, $R_T$, at an output terminal 36. It is shown in the aforementioned application that the output signals $L_T$ and $R_T$ are equivalent to those required by the SQ quadraphonic system to establish the directional position of sound sources surrounding the microphone array, the above choice of 70% for the output of L2 and R2 being a modification envisioned by application Ser. No. 685,065.

In accordance with the present invention, a system having a performance equivalent to that of the previous system (which used four gradient microphones and a single omnidirectional microphone) is achieved with but two gradient microphones and a single omnidirectional microphone. This is achieved by the system illustrated in FIG. 2 wherein two gradient microphone units 40 and 42 are supported on a common vertical axis X—X with their axes of maximum sensitivity positioned at azimuthal angles of 90° and 0°, respectively; that is, the gradient elements are at 90° relative to each other. The microphone elements are placed as close as possible to each other and also in close proximity to an omnidirectional transducer element 44. If an azimuth of 0° is arbitrarily selected as the reference direction, it is clear that the voltage output of the gradient element 42 for a sound wave of given sound pressure level will vary as the cosine of the angle of incidence with respect to the azimuth around the axis X—X measured from 0°, and the voltage output of the gradient element 40 for the same sound wave will vary as the sine function of the angle of incidence. These signals are designated $E_c$ and $E_s$, respectively, and the voltage output from the omnidirectional microphone 44 for the aforementioned sound wave, which does not vary with azimuth, is designated $E_0$. Assuming normalization to unity of the voltages $E_c(0°)$, $E_s(90°)$ and $E_0$ for the aforementioned sound wave, the polar plot shown in FIG. 3 suggests the manner in which the various signals must be combined to achieve the purposes of the invention.

Figure 3:
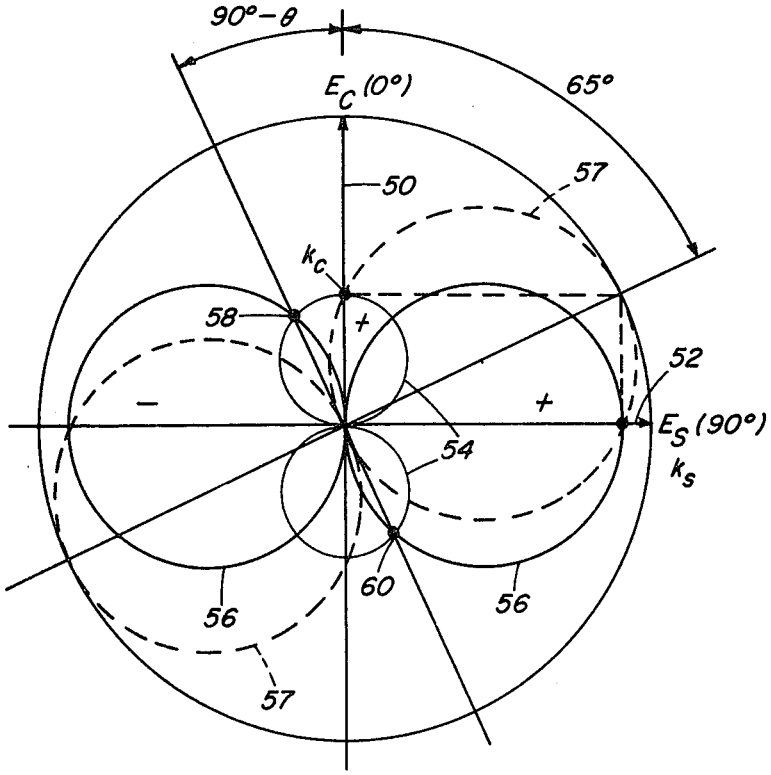
FIG. 3 is a polar sensitivity pattern of the microphone arrangement shown in FIG. 2.

In FIG. 3, the voltage $E_c(0°)$ is represented by the arrow 50 oriented in the 0° direction and having unity length. Similarly, the voltage $E_s(90°)$ is represented by the arrow 52 in the 90° direction and of unity length. It is to be understood that the arrows 50 and 52 are not phasors; they simply represent the magnitudes of the output voltages of the respective transducers for the particular directions of sound incidence. It being an object of the invention to provide a system equivalent in performance to that of the FIG. 1 system, it is necessary to form an equivalent gradient element oriented in a direction $\theta$, namely, at the angles at which the limaćon patterns of FIG. 1 are aimed, by combining fractional portions of the signals $E_c$ and $E_s$ in appropriate proportions. Defining the proportions of $E_c$ and $E_s$ by the factors $k_c$ and $k_s$, respectively, the polar patterns of the respective gradient microphones for these fractional outputs are shown at 54 and 56, and are defined by equations, for pattern 54, $$k_cE_c = k_cE_c(0°)\cos\theta$$

and for pattern 56, $$k_sE_s = k_sE_s(90°)\sin\theta$$

It is seen that one lobe of each pattern is positive and the other negative as indicated by the plus and minus signs. The null crossing of the pattern takes place when the positive and negative circles intersect, that is, at points 58 and 60, respectively. At these points, $k_cE_c = k_sE_s$, and since $E_c(0°) = E_s(90°) = 1$, then $$\frac{E_s(90°)\sin\theta}{E_c(0°)\cos\theta} = \frac{\sin\theta}{\cos\theta} = \tan\theta;$$

by simply setting $k_s = \sin\theta$ and $k_c = \cos\theta$, then the maximum value of the voltage of the newly formed gradient pattern 57-57 becomes $E(\theta) = \cos^2\theta + \sin^2\theta = 1$.

Figure 4:
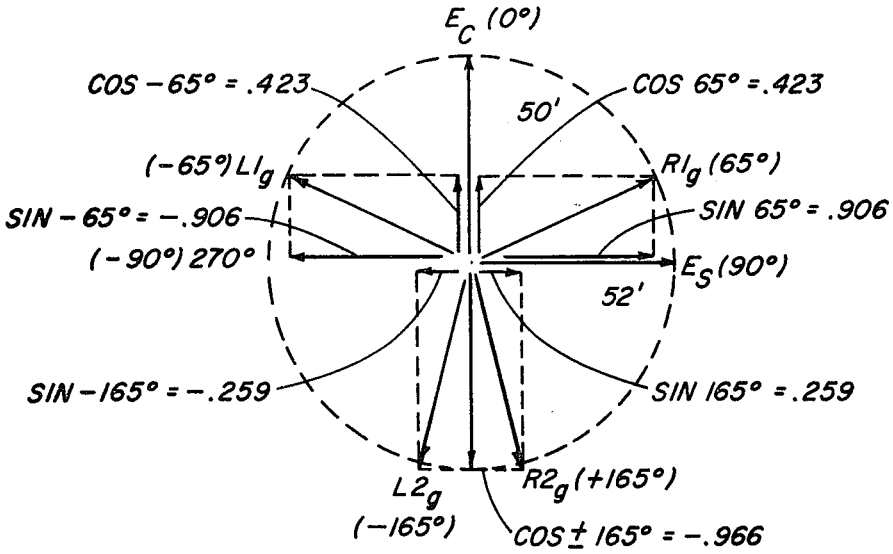
FIG. 4 is a diagram used to explain the operation of the system of FIG. 2.

The just-discussed relationships suggest the diagram shown in FIG. 4 for convenient visualization of the matrix system needed to produce the directional patterns depicted in FIG. 1. The voltages $E_c(0°)$ and $E_s(90°)$ are again shown as arrows 50' and 52', respectively, and additionally the diagram includes arrows representing the gradient transducer voltages L1 (at −65°), R1 (at +65°), L2 (at −165°) and R2 (at +165°), these corresponding to the similarly designated directional patterns in FIG. 1. By projecting the arrows representing these voltages on the 0°–180° and +90° – −90° axes, the following respective coefficients of the required matrix are obtained:

| Gradient Component | $k_c$ | $k_s$ |
|---|---|---|
| L1g(−65°) | cos − 65° = .423 | sin − 65° = −.906 |
| R1g(+65°) | cos + 65° = .423 | sin + 65° = .906 |
| L2g(−165°) | cos −165° = −.966 | sin − 165° = −.259 |
| R2g(+165°) | cos 165° = −.966 | sin + 165° = .259 |

Figure 2:
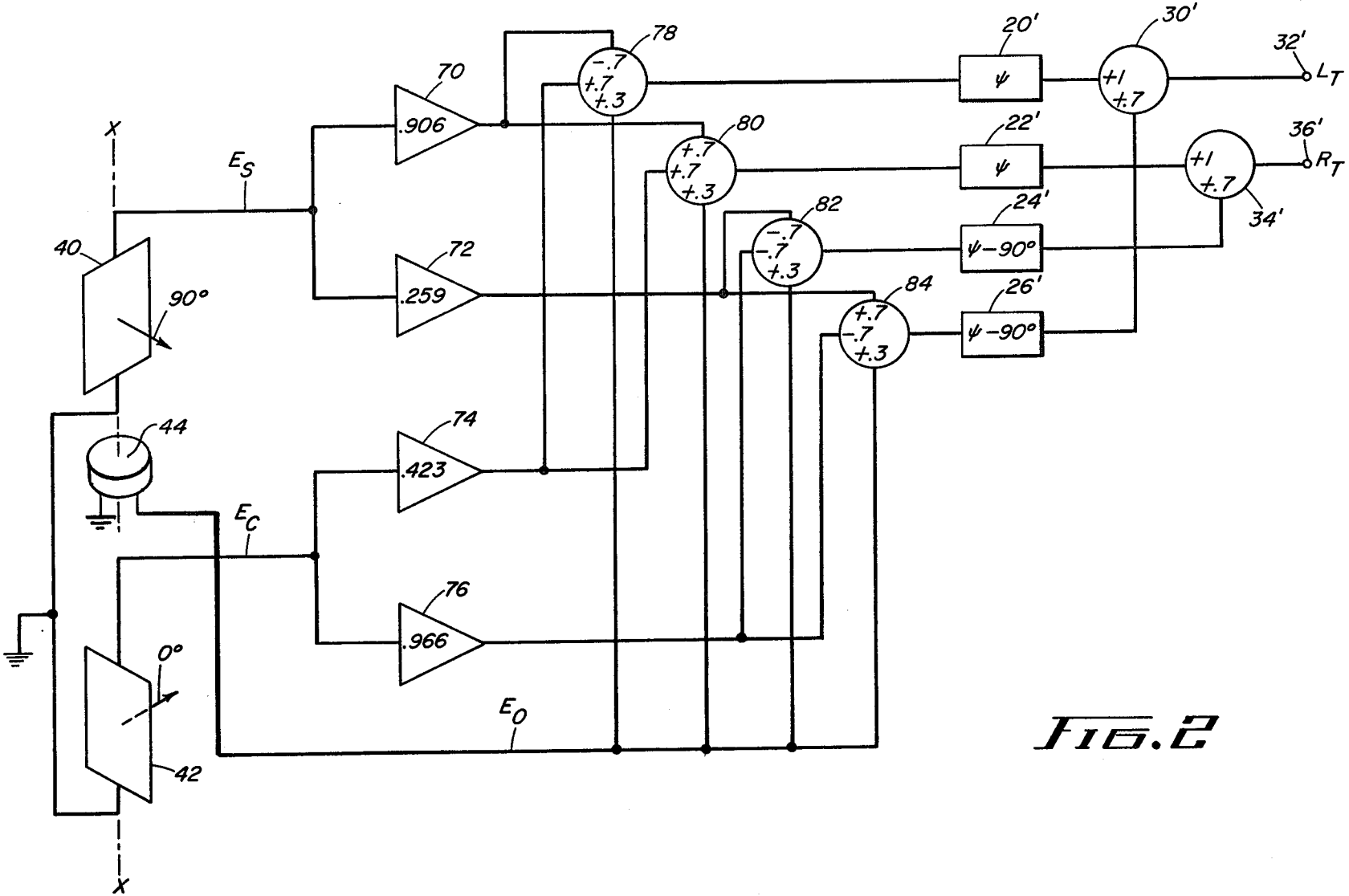
FIG. 2 is a block diagram of a microphone-encoding circuit system according to the present invention.

Thus, the appropriate directions for the four limaćon patterns depicted in FIG. 1 can be obtained with the microphone array shown in FIG. 2 by combining the $E_s$ and $E_c$ signals in accordance with the coefficients set forth in the above table. To this end, the $E_s$ signal is applied to the input of both of two amplifiers 70 and 72 designed to have amplification factors of 0.906 and 0.259, respectively, and the $E_c$ signal is applied to the input terminal of both of two additional amplifiers 74 and 76, designed to have amplification factors of 0.423 and 0.966, respectively. The output signals from these four amplifiers are combined according to the above table in respective summing junctions 78, 80, 82 and 84, being added at the junction with a further multiplicand of 0.7 for each of them. More particularly, and by way of example, 0.7 of the output signal from amplifier 70 (which is equal to 0.906 $E_s$) is subtracted in junction 78 from 0.7 of the output signal from amplifier 74. The remaining 0.3 (30%) of each of the output signals is contributed by the voltage $E_0$ from the omnidirectional transducer 44, 0.3 of which is applied as an input to each of the summing junctions 78, 80, 82 and 84. This summation process produces the desired limaćon patterns shown in FIG. 1 and designated in FIG. 2 as L1, R1, L2 and R2. These signals are applied to an encoding section, in all respects like the encoder 18 in FIG. 1, which is operative to produce the desired encoded composite output signals $L_T$ and $R_T$ at output terminals 32' and 34', respectively.

Figure 5:
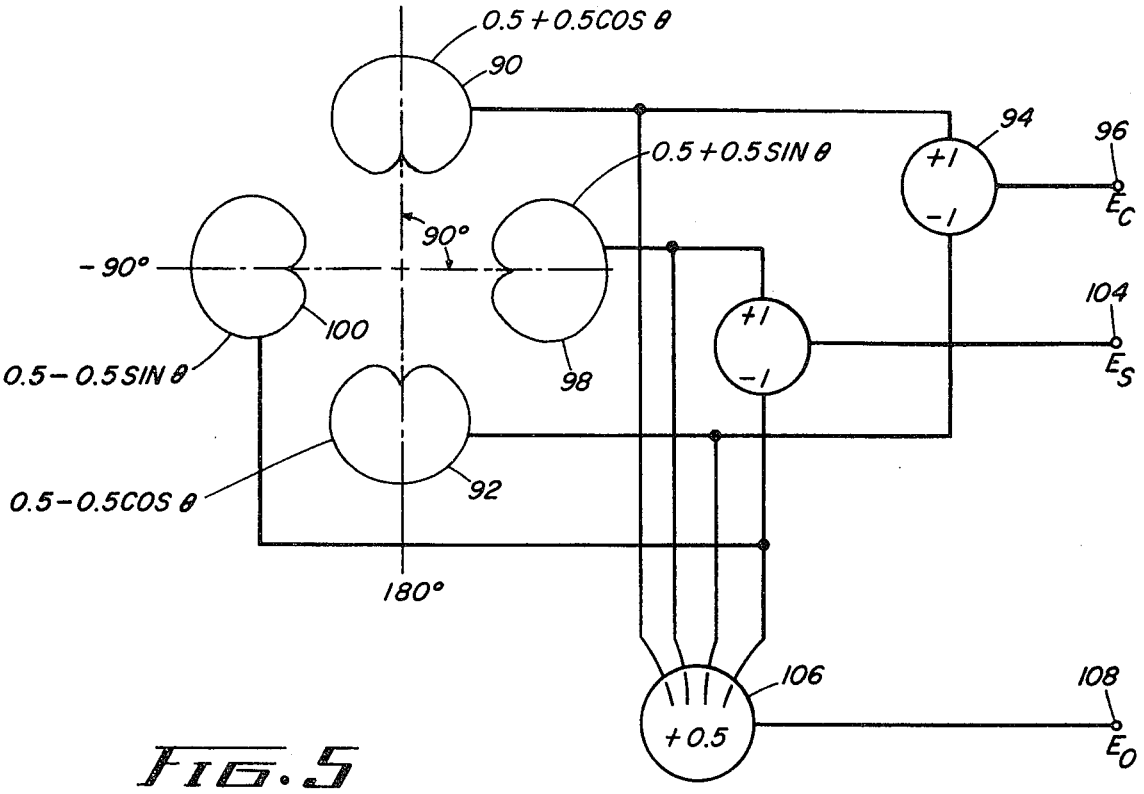
FIG. 5 diagrammatically illustrates a second embodiment of the invention.

Another aspect of the invention is applicant's recognition that by appropriate adjustment of a commercially available microphone array and judicious combination of the output signals produced thereby it is possible to achieve the desired encoded composite signals $L_T$ and $R_T$. For example, a microphone commercially available from the Neuman Company of West Berlin consists of four independent cardioid (or limaćon) pattern units mounted at 180° to each other, but adjustable so that their respective axes may be set at 90° relative to each other. Applicant has recognized that if the respective axes of this commercially available microphone are set at 90° relative to each other as shown in FIG. 5, it is possible to derive therefrom the three signals $E_c$, $E_s$ and $E_0$ obtained with the microphone array described in connection with FIG. 2 system which, when modified and combined as shown in FIG. 2, will produce properly encoded composite signals $L_T$ and $R_T$. More specifically, if one pair of the transducers of such microphone, having respective polar patterns 90 and 92, are oriented along the 0° – 180° direction, the equations of these cardioid patterns are $0.5 + 0.5\cos\theta$ and $0.5 - 0.5\cos\theta$, respectively. The signal representative of pattern 92 is subtracted in a summing junction 94 from the signal representative of the pattern 90 thereby to produce at an output terminal 96 a voltage $E_c = \cos\theta$. The other pair of transducers, the directional patterns of which are depicted at 98 and 100 are oriented in the +90° – −90° direction and follow the equations $0.5 + 0.5\sin\theta$ and $0.5 - 0.5\sin\theta$, respectively. The signal representative of the limacon pattern 100 is subtracted in a summing junction 102 from the signal representative of pattern 98 to produce at an output terminal 104 a voltage $E_s = \sin\theta$. When the two signals representative of either of the pairs are added together they produce a voltage $E_0 = 1$, or if the signals representative of all four patterns are summed, each with a coefficient of 0.5, the resultant is also $E_0$. The latter summation is illustrated in FIG. 5 where the four pattern-representing signals are added, each with a coefficient of 0.5, in a summing junction 106 to produce at the output terminal 108 the voltage $E_0$. It should be noted that it would have been sufficient to use any of the two oppositely directed pattern-representing signals with coefficients of 1.0, to obtain $E_0$; the use of all four signals, however, as shown in FIG. 5, is preferable as it better represents any possible variations of level with aging of components, etc. The resulting $E_c$, $E_s$ and $E_0$ signals have such sine, cosine and omnidirectional characteristics that when they are applied to the matrix and encoding system described in FIG. 2, the resulting composite signals $L_T$ and $R_T$ will have the characteristics required for the SQ quadraphonic system.

It is to be understood that microphone combinations other than those specifically described may be employed to achieve a similar purpose. For example, the two pairs of patterns shown in FIG. 2 and FIG. 5 need not be at 90° to each other, and suitable modifications of coefficients in FIG. 2 might be used to take into account the variation in angle. Also, the patterns shown in FIG. 5 need not necessarily have the equation $0.5 + 0.5\cos\theta$ (cardioid), but may be any member of the limaćon family, given by the general equation $m + (1-m)\cos\theta$, where $0<m<1$. Other modifications to achieve the objectives of this invention may occur to those who are skilled in the art.

Although the concept of using a microphone array and suitable combining circuitry for producing a pair of quadraphonically-encoded composite signals has been described in the aforementioned copending application and hereinabove in connection with the SQ quadraphonic system, it is also applicable for the production of composite encoded signals having other characteristics, for example that used in the RM quadraphonic matrix system. Although the RM code (which stands for "regular matrix") has not had the acceptance enjoyed by the SQ code, it is favored by some and it is, therefore, desirable that users of this code have available a system which allows placement of a microphone array within a surround-sound environment.

Figure 6:
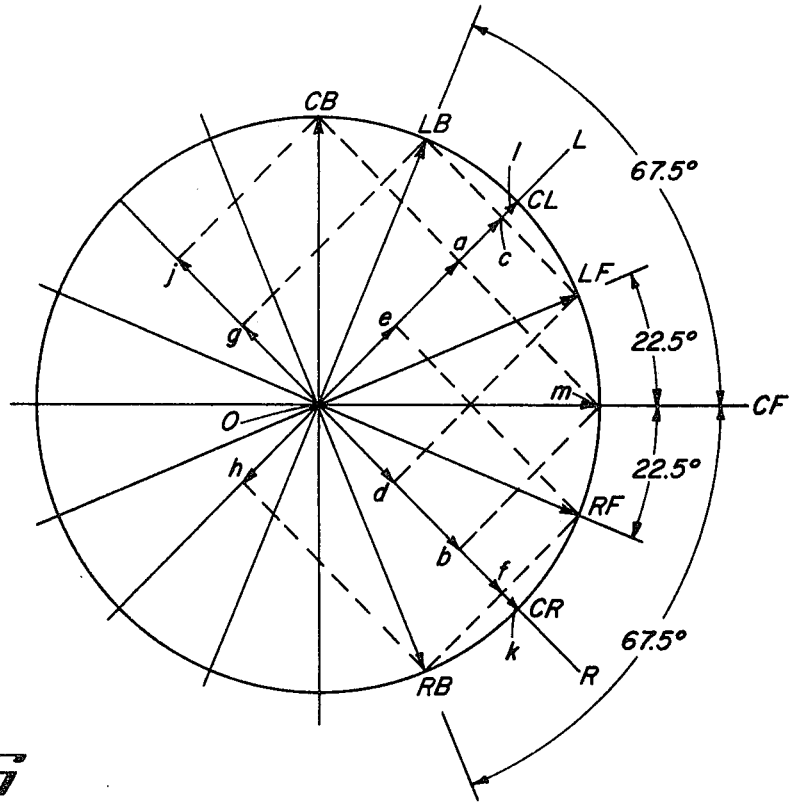
FIG. 6 is a diagram used to illustrate the RM system of encoding in terms of the motion of a stylus of a phonograph cutter or pickup.

Before describing a microphone-encoder system for doing so, it will be useful to briefly describe the matrix system. While several encoder matrix networks have been devised to produce two output signals encoded according to the RM code to correspond to directional input signals from various signal sources, none of the systems known to applicant produce the RM code ideally. Accordingly, this code will be described in terms of the motion of a stylus of a phonograph cutter or pickup. Referring to FIG. 6, which is an end view of a disc cutter or phonograph pickup, the arrows labelled L and R designate directions of motion corresponding to the left channel only and right channel only signals, respectively. The at-rest position of the stylus is at the center of the circle, labelled O. According to the RM code, in the case of a signal originating from the "center right" (CR) direction, the motion of the stylus is on the line O-*k* (which is assumed to have unity length), and has no component along the left (L) axis O-*l*; thus, a "center right" signal produces a signal in only the right (R) channel. Similarly, in the case of a "center left" (CL) signal the direction of motion is along the O-*l* axis only, which is assumed to also be of unity length, and has no component along the right (R) axis; thus, a signal arriving from "center left" produces only a left (L) signal having a relative magnitude of unity.

A "center front" (CF) signal causes stylus motion along the axis O-*m*, and is seen to have two components O-*a* and O-*b* along the L and R axis, respectively; since O-*m* has unity length, these components, being at an angle of 45° relative to the axis O-*m*, are each cos45°, or 0.707 units long.

A "left front" (LF) signal according to the RM code results in a 22½° modulation, labelled LF, which, it will be noted, has a component -*c* of a length equal to cos22.5° = 0.92 for the left channel, and a component O-*d* displaced 62.5° from LF, and thus of a length equal to cos62.5° = 0.38. Thus a unity LF signal according to the RM code results in an output of 0.92 units in the LT (left total) channel and 0.38 units in the right channel. As one goes around the circle, it is possible to similarly identify the specific modulations, and the pairs of signals $L_T$ and $R_T$ which correspond to the various directions of sound arrival. These pairs of signals, corresponding to eight cardinal directions around the circle, are graphically depicted in FIG. 7.

Figure 8:
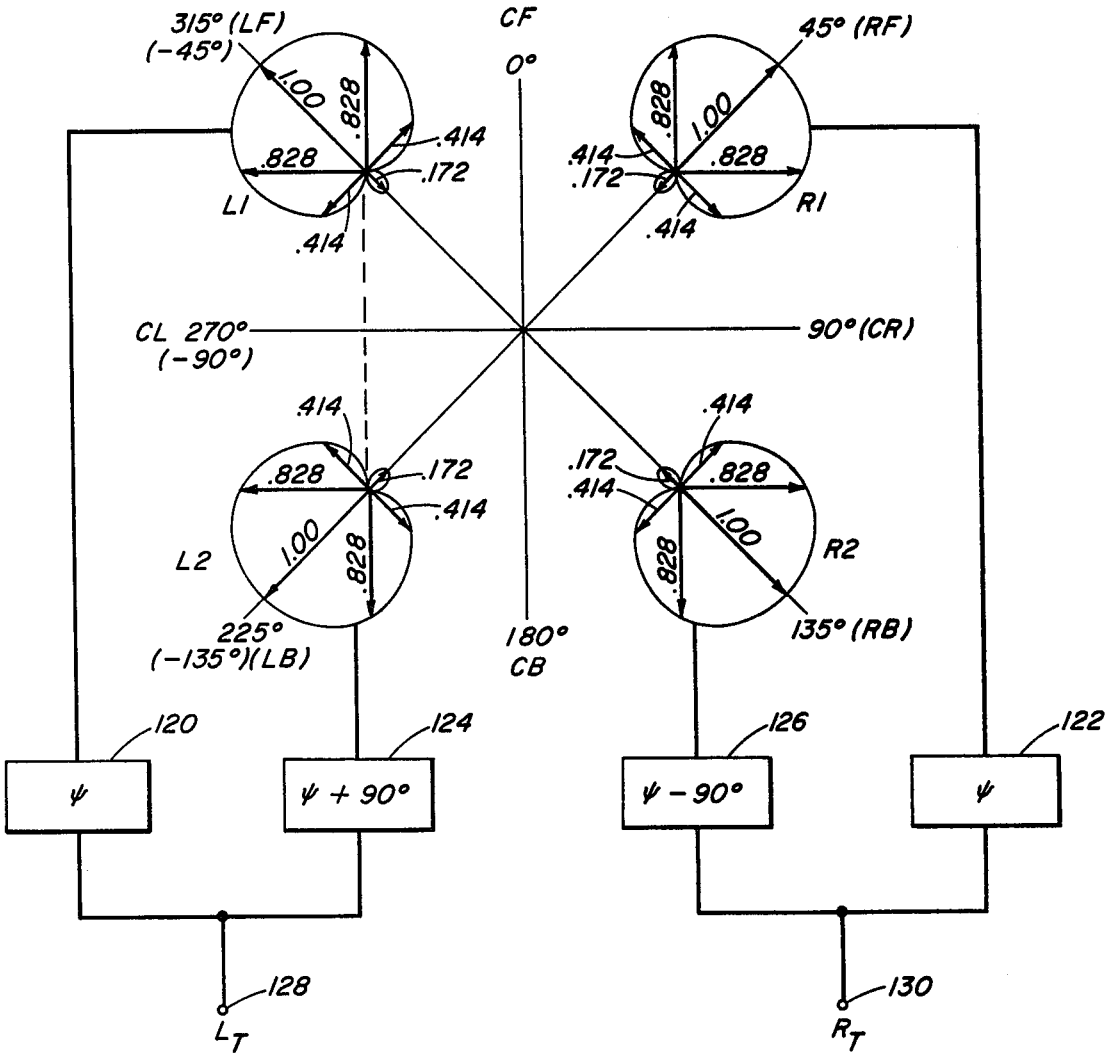
FIG. 8 diagrammatically illustrates a system embodying the invention for producing composite signals of the kind required in the RM quadraphonic system.

Composite signals having components satisfying the RM code are obtainable with the system illustrated in FIG. 8 which includes a cluster of four limaćon microphones the limaćon patterns of each of which follow the equation $0.414 + 0.586\cos\phi$, where $\phi$ is the angular direction measured from the direction of maximum sensitivity. The microphones are arranged such that the directions of maximum sensitivity of the respective microphones are displaced from each other by 90°; it will be understood that in the actual physical embodiment the acoustical centers of the four microphones are preferably located on a common vertical axis, not separated as shown in FIG. 8, which is only for clarity of presentation. The relative sensitivity of this pattern in eight directions in space is shown by radii vectors inside the limaćon patterns; it will be noted that the sensitivity in the direction 135° with respect to the direction of maximum sensitivity in each case is zero. The significance of this observation will become evident as the description proceeds.

The signals corresponding to the two "front" limaćon patterns, designated L1 and R1, are applied to respective all-pass phase-shifting networks 120 and 122, each having a transmission characteristic $\psi$ as a function of frequency. The output signals representative of limaćon patterns L2 and R2 are applied to respective phase-shift networks 124 and 126, also all-pass networks but differing from networks 120 and 122 in that network 124 introduces a phase-shift differing by +90° from the phase-shift introduced by network 120 and network 126 introduces a phase-shift differing by −90° from the phase-shift introduced by network 122. The phase-shifted signals appearing at the outputs of networks 120 and 124 are combined to produce a composite or "total" output for the left channel at terminal 128, and the output signals from networks 122 and 126 are similarly combined to produce an encoded right channel signal at output terminal 130.

Figure 9:
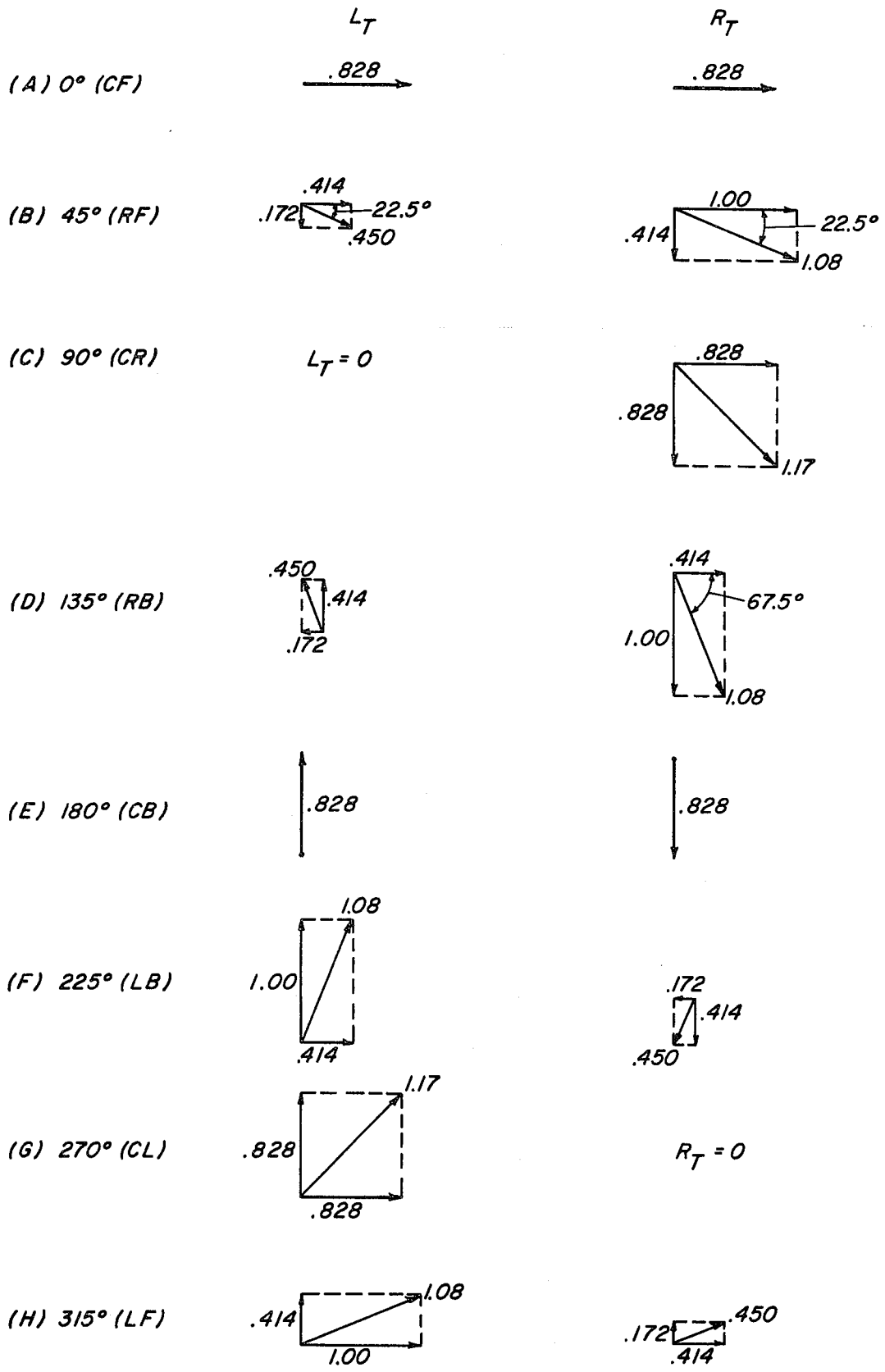
FIG. 9 shows a multiplicity of phasor diagrams used to explain the operation of the system of FIG. 8.

It will now be demonstrated, with reference to FIGS. 8 and 9, that the described arrangement of microphones and phase-shifting networks provides composite signals $L_T$ and $R_T$ having the characteristics of RM-encoded signals. It will be seen from FIG. 8 that for a "center front" (CF) signal, the two "front" microphones L1 and R1 for an acoustical signal of unity strength each produce an output of 0.828 units, which, because the microphones are identical, are in-phase. This result is shown in FIG. 9(A) by the two arrows shown under the column headings $L_T$ and $R_T$ each of which is 0.828 units long.

For a "right front" (RF) signal, incident from the +45° direction, microphone L1 produces an output signal of 0.414 units and microphone L2 produces an output signal of 0.72 units, the latter being negative; when these in-phase and quadrature components are combined by the phase-shift networks 120 and 124, a phasor $L_T$ having a relative length of 0.450 is obtained. The combination of these components is depicted in FIG. 9(B); because the output of microphone L2 is negative the phasor $L_T$ is shown lagging behind the output of microphone $L_1$, instead of leading it. The output of microphone R1 for a "right front" (RF) signal is 1.00 and the output of microphone R2 has a relative amplitude of 0.414; when these outputs are combined in the manner shown in FIG. 9(B) a "total" output signal $R_T$ having an amplitude of 1.08 is obtained. It is seen that the signals $L_T$ and $R_T$ are in-phase and have relative lengths of 0.450 and 1.08; except for the absolute lengths this pair of signals corresponds to the pair of signals depicted in FIG. 7 for the RF direction.

For a 90° direction of incidence of a sound signal, that is, a center right (CR) signal, the outputs from microphones L1 and L2 are both zero, whereas the output signals from microphones R1 and R2 each have a relative amplitude of 0.828. By reason of the action of phase shift networks 126 and 122, these two signals are combined in quadrature resulting in a total $R_T$ signal having a relative amplitude of 1.17, as shown in FIG. 9(C). Again, except for the magnitude of the $R_T$ signal, this pair of signals corresponds to the signals for the CR position depicted in FIG. 7.

Figure 7:
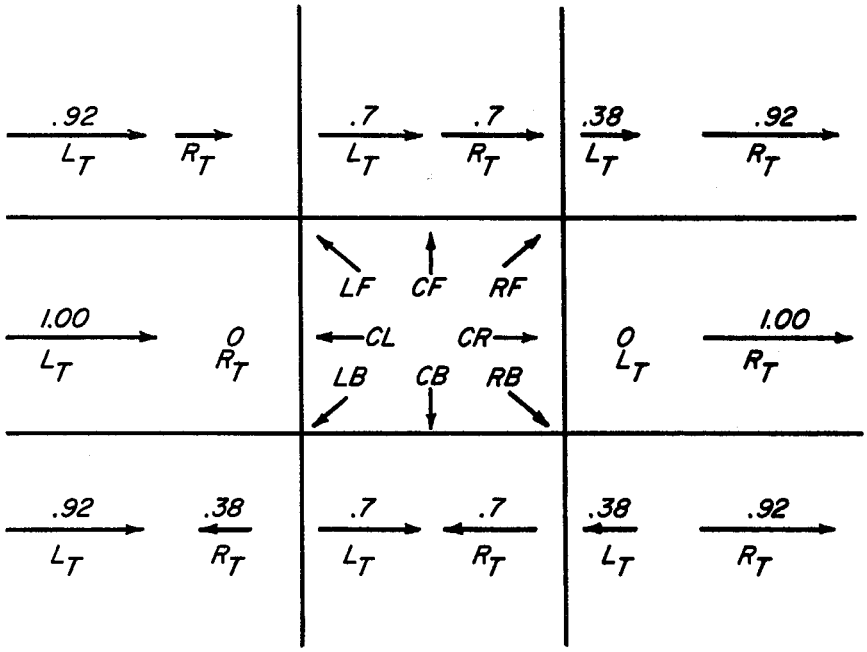
FIG. 7 shows a multiplicity of phasor diagrams used to explain the derivation of the system of FIG. 8.

Continuing around the circle and determining the relative amplitudes of the signals produced by each of the four microphones for different directions of sound arrival, and combining them in the described phase-shift networks, it will be seen from FIG. 9(D) through FIG. 9(H) that output voltages $L_T$ and $R_T$ for different directions of sound arrival are the same as those shown in FIG. 7 for corresponding directions, except for a difference in absolute magnitude. The latter is not of significance, however, because if all of the values of the $L_T$ and $R_T$ phasors in FIG. 9 are divided by the factor 1.17, the relative outputs $L_T$ and $R_T$ become identical in relative magnitudes and phases to those shown in FIG. 7 for the corresponding directions of arrival. This division, if desired, can be achieved by appropriately attenuating the $L_T$ and $R_T$ signals delivered at output terminals 128 and 130 of the system of FIG. 8.

The four limaćon patterns in FIG. 8 may be obtained by slight internal modifications of the aforementioned commercial microphone made by the Neumann Company; or alternately, by following the precepts embodied in FIGS. 2 and 5, they can be obtained by a modified matrixing approach, as will now be evident to those skilled in the art.

It is seen from the foregoing and the aforementioned copending application, that composite signals $L_T$ and $R_T$ as required by matrix four-channel sound systems, such as the SQ and RM systems, can be obtained with a system comprising a single array of microphones and appropriate networks for combining the output signals from the microphones of the array. It will now be evident to ones skilled in the art that composite signals according to other specific codes can be obtained with a similar system by suitable choice of components.

I claim:

1. Apparatus for producing composite signals $L_T$ and $R_T$, for use in a matrix quadraphonic sound system wherein first and second channels carry the composite signals $L_T$ and $R_T$, respectively, and wherein each composite signal contains predetermined amplitude portions of three or more directional input signals representative of corresponding acoustical signals, to the extent they are present, in predetermined phase relationships, the composite signals when decoded by a decoder appropriate to the matrix system producing three or more output signals each containing a different directional signal as its predominant component, the apparatus for producing the said composite signals comprising, in combination:

means including an array of microphones supported in close proximity to each other for producing when disposed within a sound field a plurality of signals the relative amplitudes of which is a measure of the direction of incidence of a sound signal relative to a reference direction, said array comprising first and second gradient microphones supported with the axis of maximum sensitivity of said first microphone in said reference direction and with the axis of maximum sensitivity of said second microphone in a direction azimuthally displaced from said reference direction by 90° for respectively producing a first and a second of said plurality of signals, the amplitudes of which vary as the cosine and sine, respectively, of the azimuthal angle defined by said reference direction and the direction of arrival of an incident acoustical signal, and an omnidirectional microphone for producing a third of said plurality of signals the amplitude of which is invariant with direction of acoustical signal incidence, means for combining a predetermined portion of said third signal with each of four selected combinations of predetermined portions of said first and second signals for producing first, second, third and fourth intermediate signals each representative of a predetermined limaćon sensitivity pattern having the equation $E = k + (1-k)\cos\theta$ whose directions of maximum sensitivity are oriented at different predetermined angles relative to said reference direction, means for relatively shifting the phase of said first and second intermediate signals by a predetermined phase angle and for combining said relatively phase-shifted first and second intermediate signals for producing the $L_T$ signal, and means for relatively shifting the phase of said third and fourth intermediate signals by a predetermined phase angle and for combining said relatively phase-shifted third and fourth intermediate signals for producing the $R_T$ signal.

2. Apparatus according to claim 1, wherein said predetermined phase angle is about 90°.

3. Apparatus according to claim 2, wherein the said first and second intermediate signals define sensitivity patterns whose directions of maximum sensitivity are oriented at about −65° and about +165°, respectively, from said reference direction, and wherein said third and fourth intermediate signals define sensitivity patterns whose directions of maximum sensitivity are oriented at about +65° and about −165°, respectively, from said reference direction.

4. Apparatus for producing composite signals $L_T$ and $R_T$, for use in a matrix quadraphonic sound system wherein first and second channels carry the composite signals $L_T$ and $R_T$, respectively, and wherein each composite signal contains predetermined amplitude portions of three or more directional input signals representative of corresponding acoustical signals, to the extent they are present, in predetermined phase relationships, the composite signals when decoded by a decoder appropriate to the matrix system producing three or more output signals each containing a different directional signal as its predominant component, the apparatus for producing the composite signals comprising, in combination:

an array of microphones comprising an assembly of four transducers in close proximity to each other each having a limaćon sensitivity pattern defined by the equation $E = 0.5 + 0.5\cos\theta$ and whose directions of maximum sensitivity are azimuthally displaced one from the other by about 90°, and the direction of maximum sensitivity of a first of which is oriented in said reference direction, for producing when disposed within a sound field a plurality of signals the relative amplitudes of each of which is a function of the angle $\theta$ between the direction of incidence of a sound signal and said reference direction, means for combining the signals produced by the two transducers disposed on the axis coincident with said reference direction for producing a first signal the amplitude of which varies as the cosine of said angle $\theta$, means for combining the signals produced by the two transducers disposed on the axis disposed at 90° to said reference direction for producing a second signal the amplitude of which varies as the sine of said angle $\theta$, means for combining selected signals produced by said four transducers for producing a third signal the amplitude of which is invarient with the direction of incidence of a sound signal, means for combining a predetermined portion of said third signal with each of four selected combinations of predetermined portions of said first and second signals for producing first, second, third and fourth intermediate signals each representative of a predetermined limacon sensitivity pattern whose directions of maximum sensitivity are oriented at different predetermined angles relative to said reference direction, means for relatively shifting the phase of said first and second intermediate signals by about 90° and for combining said relatively phase-shifted first and second intermediate signals for producing the $L_T$ signal, and means for relatively shifting the phase of said third and fourth intermediate signals by about 90° and for combining said relatively phase-shifted third and fourth intermediate signals for producing the $R_T$ signal.

5. Apparatus according to claim 4, wherein said first and second intermediate signals define sensitivity patterns whose directions of maximum sensitivity are oriented at about −65° and about +165°, respectively, from said reference direction, and wherein said third and fourth intermediate signals define sensitivity patterns whose directions of maximum sensitivity are oriented at about +65° and about −165°, respectively, from said reference direction.

6. Apparatus for producing composite signals $L_T$ and $R_T$, for use in a matrix quadraphonic sound system wherein first and second channels carry the composite signals $L_T$ and $R_T$, respectively, and wherein each composite signal contains predetermined amplitude portions of three or more directional input signals representative of corresponding acoustical signals, to the extent they are present, in predetermined phase relationships, the composite signals when decoded by a decoder appropriate to the matrix system producing three or more output signals each containing a different directional signal as its predominant component, the apparatus for producing the said composite signals comprising, in combination:

an array of microphones comprising a cluster of four microphones supported in close proximity to each other each having a limacon sensitivity pattern substantially according to the equation $E + 0.414 + 0.586 \cos \theta$, where $\theta$ is the angular direction measured from the direction of maximum sensitivity, whose directions of maximum sensitivity are azimuthally displaced one from the next by about 90°, and the direction of maximum sensitivity of a first of which is displaced by about +45° from said reference direction and each operative to produce when disposed within a sound field a respective signal the amplitude of which is a measure of the direction of incidence of a sound signal relative to said reference direction, means for relatively shifting by about 90° the phase of the signals produced by the two microphones whose maximum sensitivity directions are oriented at −45° and −135°, respectively, relative to said reference direction and for combining said relatively phase-shifted signals for producing the $L_T$ signal, and means for relatively shifting by about 90° the phase of the signals produced by the two microphones whose maximum sensitivity directions are oriented at +45° and +135°, respectively, relative to said reference direction and for combining said relatively phase-shifted signals for producing the $R_T$ signal.

* * * * *